US006256000B1

(12) United States Patent
Yanagisawa et al.

(10) Patent No.: US 6,256,000 B1
(45) Date of Patent: Jul. 3, 2001

(54) MOTOR DRIVEN ANTENNA APPARATUS

(75) Inventors: Wasuke Yanagisawa, Machida; Ryo Horie, Saitama; Takumi Yano, Sugihami-ku; Takao Kawahara, Ayase; Yuichi Kagoshima, Takasaki; Tomio Anbe, Tomioka, all of (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 09/357,817

(22) Filed: Jul. 20, 1999

Related U.S. Application Data

(63) Continuation of application No. PCT/JP98/00168, filed on Jan. 19, 1998.

(30) Foreign Application Priority Data

Jan. 28, 1997 (JP) ..... 9-028529
Jan. 28, 1997 (JP) ..... 9-028533
Jan. 29, 1997 (JP) ..... 9-029649
Jan. 29, 1997 (JP) ..... 9-029650

(51) Int. Cl.[7] ..... H01Q 1/10
(52) U.S. Cl. ..... 343/903; 343/766; 343/895
(58) Field of Search ..... 343/711, 713, 343/766, 757, 758, 895, 903, 715

(56) References Cited

U.S. PATENT DOCUMENTS

| | | | | |
|---|---|---|---|---|
| 4,520,365 | | 5/1985 | Langheck | 343/903 |
| 4,829,317 | * | 5/1989 | Shinkawa | 343/903 |
| 4,864,322 | * | 9/1989 | Yamamoto et al. | 343/903 |
| 4,990,929 | * | 2/1991 | Nakase et al. | 343/715 |
| 5,130,719 | * | 7/1992 | Nakase et al. | 343/903 |
| 5,214,440 | * | 5/1993 | Takahashi et al. | 343/715 |
| 5,451,974 | | 9/1995 | Marino | 343/895 |
| 5,714,958 | * | 2/1998 | Rudisill | 343/703 |
| 5,859,622 | * | 1/1999 | Phillips | 343/903 |
| 5,929,826 | * | 7/1999 | Shinkawa et al. | 343/903 |
| 6,043,796 | * | 3/2000 | Shinkawa et al. | 343/903 |

FOREIGN PATENT DOCUMENTS

WO 8303715 10/1983 (WO) .

* cited by examiner

*Primary Examiner*—Hoanganh Le
*Assistant Examiner*—Thuy Vinh Tran
(74) *Attorney, Agent, or Firm*—Birch, Stewart, Kolasch & Birch, LLP

(57) ABSTRACT

A motor-driven antenna device in which an antenna element (10) has a short protruding length so that the outer dimension of the entire device is reduced, and in which damping of an AM-band signal by a signal path is restrained with a small stray capacitance. A rack cord (12) to be meshed with a pinion gear (24) is connected to a proximal portion of the antenna element (10) made of a helical coil over its entire length, and the antenna element (10) is caused to protrude and move to be housed by rotational driving of a motor drive section. The rack cord (12), the motor drive section and the pinion gear (24) are housed in a case (14), and a guide (26) to which the rack cord (12) is abutted and moves while bending is provided in the case (14). Thus, the rack cord (12) is abutted and moves to the guide (26) by the movement of the antenna element (10). In a protruding state, a linear conductor (30) is extended from the proximal end of the antenna element (10) to penetrate an earth conductive fitting (16) and electrically connected with a connection conductive fitting (32) at a position not in contact with the earth conductive fitting (16). A feeder conductive fitting (34) elastically contacts and is electrically connected with the linear conductor (30).

18 Claims, 10 Drawing Sheets

FIG.6 ( a )
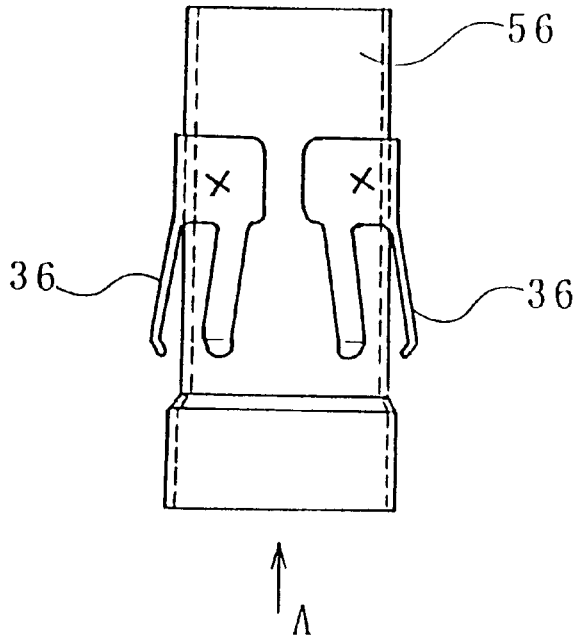
FIG.6 ( b )
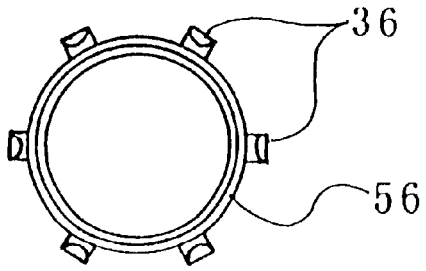

FIG.7 ( a )
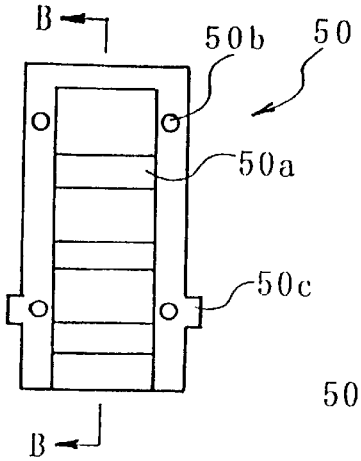
FIG.7 ( b )
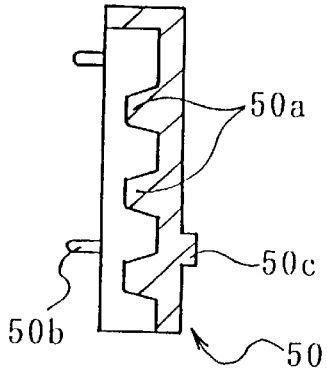
FIG.7 ( c )
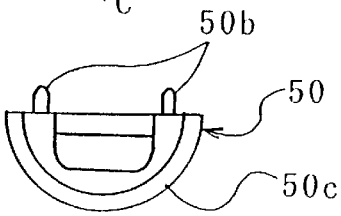
FIG.8 ( b )
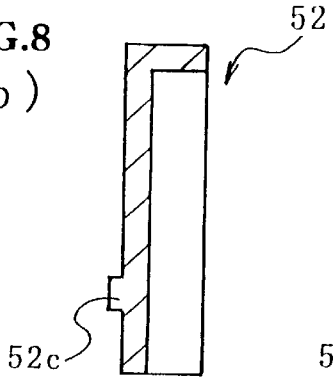
FIG.8 ( a )
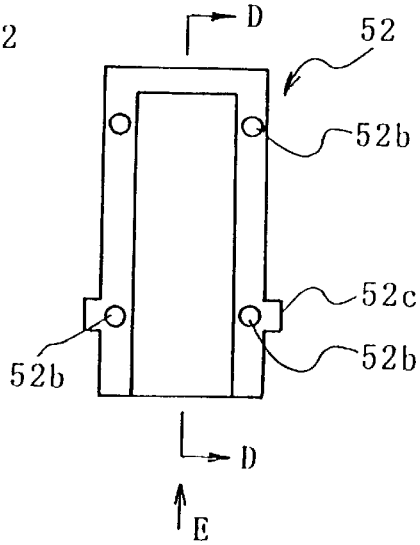
FIG.8 ( c )
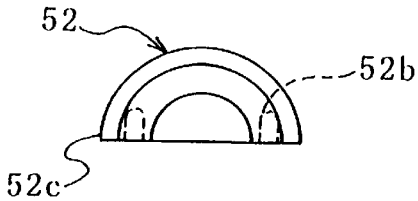

MOTOR DRIVEN ANTENNA APPARATUS

This application is a Continuation of PCT International Application No. PCT/JP98/00168 filed on Jan. 19, 1998, which designated the United States, and on which priority is claimed under 35 U.S.C. §120, the entire contents of which are hereby incorporated by reference.

FIELD OF THE INVENTION

The present invention is related to a motor driven antenna apparatus in which a projection length of an antenna is shortened. Also, the present invention is related to a motor driven antenna apparatus in which a rack cord is moved while this rack cord abuts against a guide provided within a case and is curved. Then, the present invention is related to such a motor driven antenna apparatus that a stray capacitance is reduced, and this stray capacitance is produced in a signal path for transferring an antenna output from a base end of an antenna element. Furthermore, the present invention is related to such a motor driven antenna apparatus that a base end of an antenna element is coupled to a rack cord by employing a small number of structural components, and is electrically connected to a power supply fitting member. Furthermore, the present invention is directed to such a motor driven antenna apparatus that while an antenna element is lifted, a sound is not amplified from a receiver, whereas when the antenna element is reached to the lift-up end, sound is amplified from the receiver.

BACKGROUND OF THE INVENTION

In a conventional on-vehicle motor driven antenna apparatus for receiving an AM band signal and an FM band signal, a telescopic-shaped multi-stage antenna element is used, and a tip portion of a rack cord is coupled to a base end of the topmost element. Then, a pinion gear coupled to a motor drive unit is geared with the rack of this rack cord, and the rack cord is moved by either the normal rotation or the reverse rotation of the motor drive unit. As a result, the multi-stage antenna element is projected, or moved to be stored. This multi-stage antenna element is so arranged that a project length of this antenna element is set to be approximately 1 m in order that the FM band signal can be resonated, and also the rack cord owns a length of approximately 1 m. Therefore, under storage condition of the multi-stage antenna element, the rack cord is stored in a case such that this rack cord is wound on a winding drum which is rotatably provided by the rotary shaft.

There are high risks that since the projection length of this multi-stage antenna element is long, this multi-stage antenna element is broken by receiving unexpected strong force, and furthermore, this broken multi-stage antenna element may scratch other appliances. Also, it is not desirable in view of design aspect that the rod-shaped member having the length of approximately 1 m is projected from the vehicle body. Also, apparently, such a long rack cord owns flexibility so as to be wound/stored. On the other hand, this long rack cord must own the anti-buckling characteristic in order that the multi-stage antenna element is pushed up so as to be brought into the projected condition. As a result, since there are two different natures of the flexibility and the anti-buckling characteristic, the material of the rack cord and the size thereof are considerably restricted. Moreover, even when there is such a rack cord designed to realize a better balance between the flexibility and the anti-buckling characteristic, in the case that excessively large loads are given to this rack cord because of the problem of this multi-stage antenna element, or the characteristic is deteriorated due to lifetime, unbalance conditions occur as to the flexibility and the anti-buckling characteristic. As a result, there is such a problem that malfunction readily occurs.

As a consequence, the present invention provides the following motor driven antenna apparatus. That is, although the antenna effective length of the antenna element is equal to about 1 m similar to that of the prior art, the physical length thereof can be shortened, for instance, 15 cm, which is realized by the helical coil. When this very short antenna element is employed, this antenna can be hardly damaged and also can hardly scratch other electronic appliances because of such a short projection length. Also, the rack cord for projecting and storing this short antenna element can be similarly shortened, so that the rack cord can be easily designed.

As a consequence, with respect to the above-described antenna element, since the antenna effective length is equal to approximately 1 m, this antenna element can be resonated as to the FM band signal, so that a similar reception characteristic to that of the conventional long antenna element can be obtained. However, since the physical length thereof is shortened, the reception characteristic should be deteriorated as to the AM band signal. Then, an AM band signal having a low level, which is contained in the antenna output, is furthermore attenuated in the signal path defined from the antenna element to the receiver. Thus, the reception sensitivity for the AM receiver would be deteriorated. Then, there is a problem that the structure for coupling the base end portion of the antenna element to the tip portion of the rack cord would become complex, and furthermore, the mechanical strength cannot be sufficiently obtained. In addition, even when it is practically possible to obtain a sufficiently high reception characteristic under such a condition that the antenna element is completely projected, the signal level of the AM band signal would be furthermore low under such a condition that while this antenna element is projected in a half way, the physical length operable as the antenna is further shortened. When such a low level AM band signal is amplified by the receiver, noise is emphasized which may give unpleasant feelings to users. As a consequence, even when such an antenna structure is employed in which when the antenna element reaches the complete projection condition, the base end of the antenna element is elastically made in contact with the power supply member, no signal is applied to the amplification means until the antenna element is brought into the complete projection condition. Therefore, there is such a risk that the noise is produced from this amplification means.

SUMMARY OF THE INVENTION

The present invention has an object to provide such a motor driven antenna apparatus that a projection length of an antenna element is short, and further, an outer dimension of an entire antenna apparatus can be shortened. Also, the present invention has another object to provide such a motor driven antenna apparatus that while a stray capacitance is reduced and an external load impedance is increased, an attenuation of an AM band signal caused by a signal path through which an antenna output is transferred is suppressed. Then, the present invention has another object to provide such a motor driven antenna apparatus that a base end of an antenna element is firmly coupled to a rack cord by employing a small number of components, and is electrically connected to a power supply fitting member. Furthermore, the present invention has another object to provide a motor driven antenna apparatus in which an antenna output is not amplified by a receiver until an antenna element is brought into a completely projected state.

Then, a motor driven antenna apparatus, according to the present invention, is featured by that the motor driven antenna apparatus is arranged in such a manner that a rack cord is coupled in a coaxial direction to a base end portion of an antenna element, the entire portion of which is constructed of a helical coil; a pinion gear coupled to a motor drive unit is geared with a rack of this rack cord; and the antenna element is moved to be projected and stored by way of rotating drive of the motor drive unit. In accordance with the above arrangement, it is possible to obtain such a motor driven antenna apparatus that the projection length of the antenna element is very short. Also, the rack cord is short, and the rack cord can be very easily designed. Moreover, the outer diameter dimension of the entire antenna apparatus can be shortened.

Also, the motor driven antenna apparatus is arranged by that the rack cord, the motor drive unit, and the pinion gear are stored into a case; a guide is provided in this case by which the rack cord can be moved while the rack cord abuts against this guide with being curved; the antenna element is moved so as to be projected and stored by rotating drive of the motor drive unit; and the rack cord is moved while the rack cord abuts against the guide. In accordance with the above-described arrangement, since the rack cord is properly curved by the guide, the arrangement of this motor driven antenna apparatus can be made simpler than the conventional antenna apparatus in which the antenna element is wound on the winding drum to be stored thereinto.

Furthermore, a motor driven antenna apparatus, according to the present invention, is featured by that the motor driven antenna apparatus is arranged in such a manner that an antenna element is freely projected/stored from/into a cylindrical-shaped base along an axial direction; the cylindrical-shaped base is penetrated through a hole formed in a vehicle body; an earth fitting member is fitted into an outer peripheral portion of the cylindrical-shaped base; a sandwiching member is inserted into the outer peripheral portion of the cylindrical-shaped base and also a top nut is screwed to a tip portion of the cylindrical-shaped base; the vehicle body is sandwiched by the earth fitting member and the sandwiching member by screwing this top nut so as to fix the cylindrical-shaped base to the vehicle body; under such a condition that the antenna element is projected from the vehicle body, a straight-line-shaped conductive line is extended from a base end of the antenna element while having a length defined when the straight-line-shaped conductive line is penetrated through the earth fitting member; a connection fitting member movable along the axial direction is fixed on the cylindrical-shaped base and further such a position where the earth fitting member is not faced to this straight-line-shaped conductive line and is electrically connected thereto; and a power supply fitting member made of a conductive material and positioned in correspondence with the connection fitting member present at this position is arranged on an inner peripheral wall of the cylindrical-shaped base, so that the connection fitting member is elastically made in contact with the power supply fitting member so as to be electrically connected thereto. In accordance with this arrangement, the stray capacitance produced between the earth fitting member and the connection fitting member can be reduced, and the attenuation of the AM band signal caused by the signal path can be suppressed.

Furthermore, the motor driven antenna apparatus is arranged by that under such a condition that the antenna element is projected from the vehicle body, a base end of the antenna element is projected from either the vehicle body or an electric conductive member at the same potential as that of this vehicle body by a predetermined distance. In accordance with this arrangement, the stray capacitance produced between the antenna element and the vehicle body can be reduced, and the attenuation of the AM band signal caused by the signal path can be suppressed.

Then, alternatively, the motor driven antenna apparatus may be arranged by that a hot tube made of an electric conductive material and being long along an axis direction is arranged on an inner peripheral wall of the cylindrical-shaped base; a connection fitting member movable within the hot tube along the axis direction is arranged on the side of the base end of the antenna element and is electrically connected thereto; and under such a condition that the antenna element is projected from the vehicle body, the connection fitting member is electrically made in contact with the hot tube so as to be elastically connected thereto. In accordance with this arrangement, the earth fitting member is loosely fitted to the cylindrical-shaped base, the inner diameter of the earth fitting member can be increased, and the distance between the inner diameter of the earth fitting member and the outer diameter of the hot tube provided on the inner peripheral wall of the cylindrical-shaped base can be easily increased. The stray capacitance between these members can be decreased, and the attenuation of the AM band signal caused by the signal path can be suppressed.

Then, in addition, a motor driven antenna apparatus, according to the present invention, is featured by that the motor driven antenna apparatus is arranged in such a manner that an insulating resin covering member is provided while surrounding an outer peripheral portion of an antenna element; a connection conductive member made of an electric conductive member and for coupling one end of a rack cord is arranged on a lower end of this insulating resin covering member; a base end of said antenna element is electrically connected to this connection conductive member; a joint pipe made of an electric conductive material is engaged with this connection conductive member while bridging both the lower end portion of said insulating resin covering member and the connection conductive member and caulked so as to couple/fix the insulating resin covering member and the connection conductive member, and further to electrically connect the joint pipe to the connection conductive member; both the coupled insulating resin covering member and the rack cord are movably inserted into the cylindrical-shaped base along the axis direction; under projection condition of the antenna element, a power supply fitting member made of an electric conductive material is arranged on the cylindrical-shaped base in correspondence with the joint pipe; and the joint pipe is electrically connected to the power supply fitting member by a conductive elastic tongue. In accordance with the above-described arrangement, since the joint pipe is caulked, the antenna element can be firmly coupled to the rack cord by employing the small number of structural components. Moreover, the antenna element can be surely, electrically connected via this joint pipe to the power supply fitting member.

Also, a motor driven antenna apparatus, according to the present invention, is featured by such a motor driven antenna apparatus in which a rack cord is coupled to a base end portion of an antenna element in a coaxial direction, the entire portion of the antenna element being constructed of a helical coil; a pinion gear coupled to a motor drive unit is geared with a rack of this rack cord; the antenna element is lifted and lowered by a rotary drive of the motor drive unit; and an antenna output of the antenna element is amplified by amplifying means to output an amplified antenna output, wherein: the motor driven antenna apparatus is arranged by comprising a control means for causing the amplifying means to be set to an operating condition when the control means detects that the antenna element is located at a lift-up end. In accordance with this arrangement, since the amplifying means is brought into the operating condition under such a state that the antenna element is projected up to the lift-up end and thus the antenna output having the sufficiently high level can be obtained, there is no risk that the noise caused by the insufficient antenna output is amplified from the receiver.

Alternatively, the motor driven antenna apparatus may be arranged by employing a muting means for muting a signal path used to output the amplified signal of the amplifying means; and a control means for releasing the muting operation by the muting means when the control means detects that the antenna element is located at a lift-up end. In accordance with this structure, since the muting operation is released under such a condition that the sufficient antenna output is obtained, there is no risk that the noise is amplified, and this noise is caused by that no signal is entered into the receiver while the antenna element is being projected.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 6 indicates a joint pipe on which an electroconductive elastic tongue is provided;

FIG. 6(*a*) is a front view; and

FIG. 6(*b*) is a sectional view, taken along an arrow "A" of FIG. 6(*a*).

FIG. 7 indicates one holder for sandwiching and also gearing with one end of a rack cord;

FIG. 7(*a*) is a front view;

FIG. 7(*b*) is a sectional view, taken along an arrow "B—B" of FIG. 7(*a*); and FIG. 7(*c*) is a sectional view, taken along an arrow "C" of FIG. 7(*a*).

FIG. 8 indicates the other holder for sandwiching one end of a rack cord;

FIG. 8(*a*) is a front view;

FIG. 8(*b*) is a sectional view; taken along an arrow "D—D" of FIG. 8(*a*); and FIG. 8(*c*) is a sectional view, taken along an arrow "E" of FIG. 8(*a*).

DETAILED DESCRIPTION OF THE PREFERRED EMBODIMENT

Referring now to accompanying drawings, the present invention will be described in detail.

Figure 1:
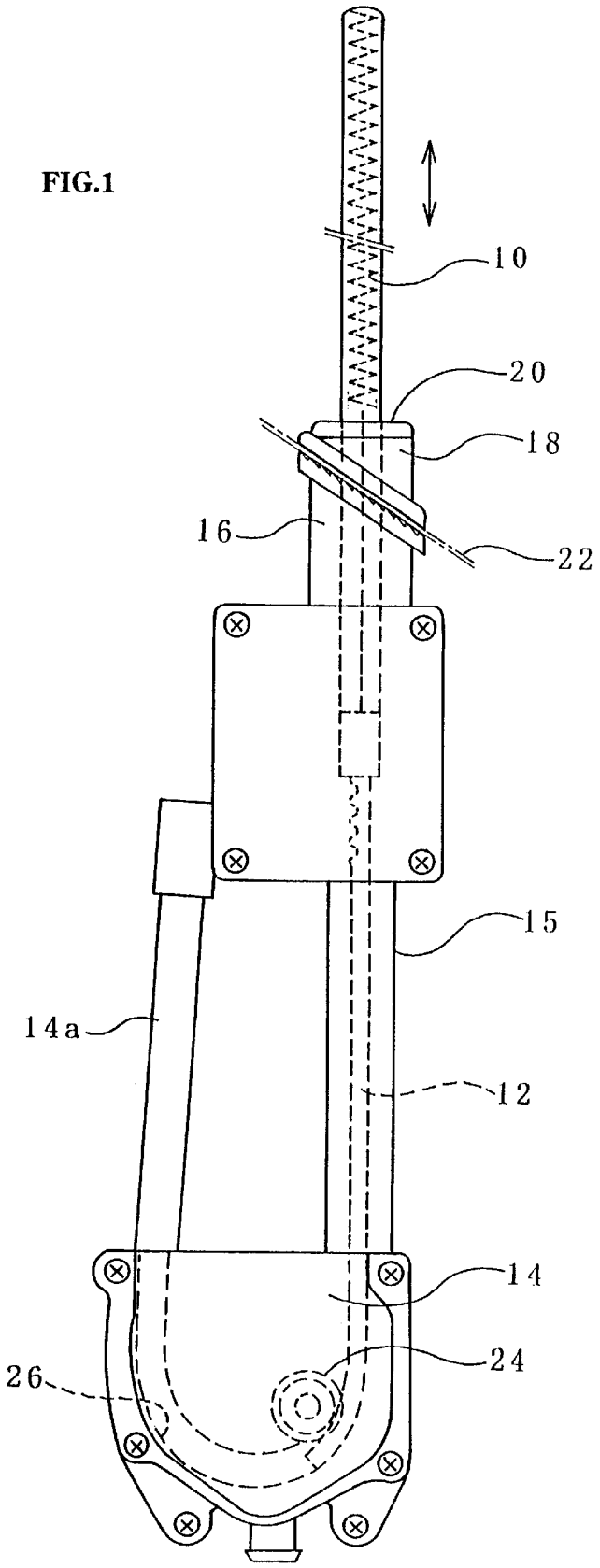
FIG. 1 shows an entire structural diagram of a motor driven antenna apparatus according to an embodiment of the present invention.
Figure 2:
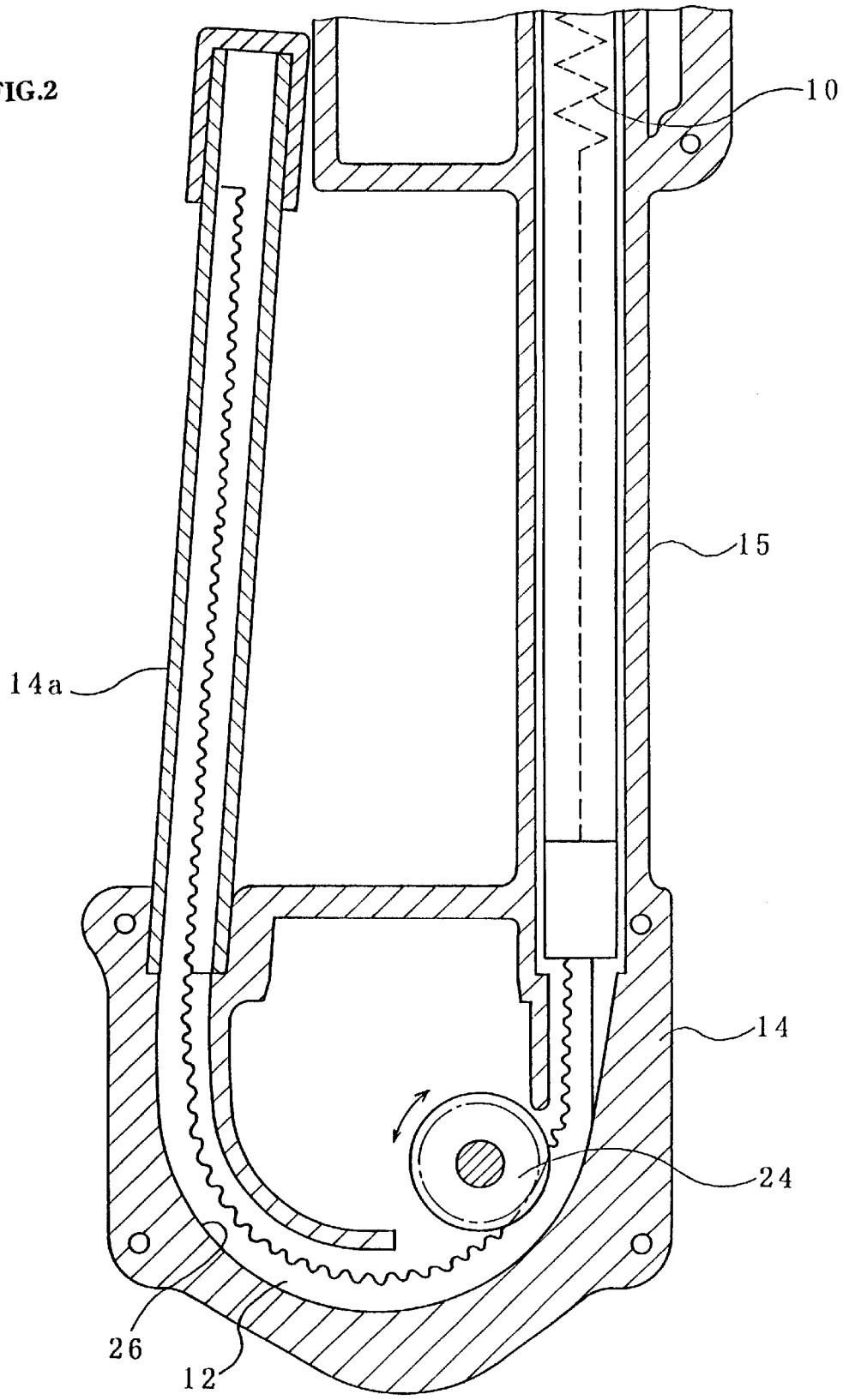
FIG. 2 is an enlarged cross-sectional view for showing a guide provided in a case indicated in FIG. 1.

In FIG. 1 and FIG. 2, an antenna element 10 whose entire portion is constructed of a helical coil is covered by an insulating resin in an integral body, and a tip portion of a rack cord 12 is properly coupled to a base end portion of this antenna element 10 (will be explained later). An antenna effective length of this antenna element 10 is approximately 1 m, and a physical length thereof is selected to be, for example, approximately 15 cm. Then, a rack is formed on one side surface of the rack cord 12, and this rack cord 12 has a properly-selected anti-buckling characteristic and properly-selected flexibility. Furthermore, a projection length of the antenna element 10 under projected state may be made substantially same length as the physical length, namely approximately 15 cm. Accordingly, the length of the rack cord 12 may be made slightly longer than approximately 15 cm.

Also, antenna output power may be properly supplied to the base end portion of the antenna element 10 by way of such a member for coupling a tip portion of the rack cord 12 to the base end portion of the antenna element 10 (will be discussed later). Then, both the antenna element 10 and the rack cord 12 are constructed in such a manner that these antenna element and rack cord are freely movable in a cylindrical-shaped base 15 formed on a case 14 along an axial direction, and furthermore, movement of these antenna element and rack cord along an extract direction is restricted with a predetermined projection length. Moreover, the cylindrical-shaped base 15 is fixed on a vehicle body 22 by employing an earth fitting member 16 and a top nut 20, or the like. This earth fitting member 16 is inserted into an outer peripheral portion of the cylindrical-shaped base 15. This top nut 20 is engaged with a sandwiching member 18 and a tip portion of the cylindrical-shaped base 15. It should be understood that the earth fitting member 16 is inserted into the cylindrical-shaped base 15 from the tip direction, and the insertable dimension of this earth fitting member 16 is restricted by a properly-designed structure.

Within the case 14, a motor drive unit (not shown) is stored/arranged, to which a pinion gear 24 geared with the rack of the rack cord 12 is coupled. Furthermore, a guide 26 of the rack cord 12 is formed in the case 14 on the down stream side from the pinion gear 24 when this pinion gear 24 is driven along the antenna storage direction, and is furthermore, formed with a pipe-shaped case member 14*a* in an integral form. This pipe-shaped case member 14*a* is formed on the case 14. This guide 26 is formed having a large curvature in such a way that the rack cord 12 abuts against this guide 26 within the case 14, so that this rack cord 12 is curved in a U-shaped range, or at an angle larger than, or equal to 180 degrees.

With employment of the above-described structure, the projection length of the antenna element 10 can be made very short, and moreover, the length of the rack cord 12 can be similarly shortened. Then, when the pinion gear 24 is driven along the antenna storage direction, the rack cord 12 is moved with being guided by the guide 26 while this rack cord 12 abuts against this side wall thereof and is curved. In this case, since the rack cord 12 is short, the anti-buckling performance required for projecting the antenna may be decreased, as compared with the anti-buckling performance required for projecting the conventional antenna by approximately 1 m. This implies that the rack cord 12 may have the higher flexibility. As a result, the rack cord 12 may be moved in a smooth manner while being guided by the guide 26. As previously described, since the rack cord 12 is curved to be stored into the case 14 and the case member 14*a*, the outer dimension of the overall apparatus can be shortened. In addition, the structure of this antenna apparatus becomes simple, as compared with such a conventional antenna apparatus that the freely rotating wind-up drum is used. In response to the shape of the guide 26, the transverse width of the case 14 may be properly designed, and this transverse width of the case 14 may be decreased. This guide 26 owns such a curvature required to curve the rack cord 12 in a substantially U shape. Also, since there is no serious limitation in the flexibility and the anti-buckling characteristic, the rack cord 12 can be very easily designed.

Figure 3:
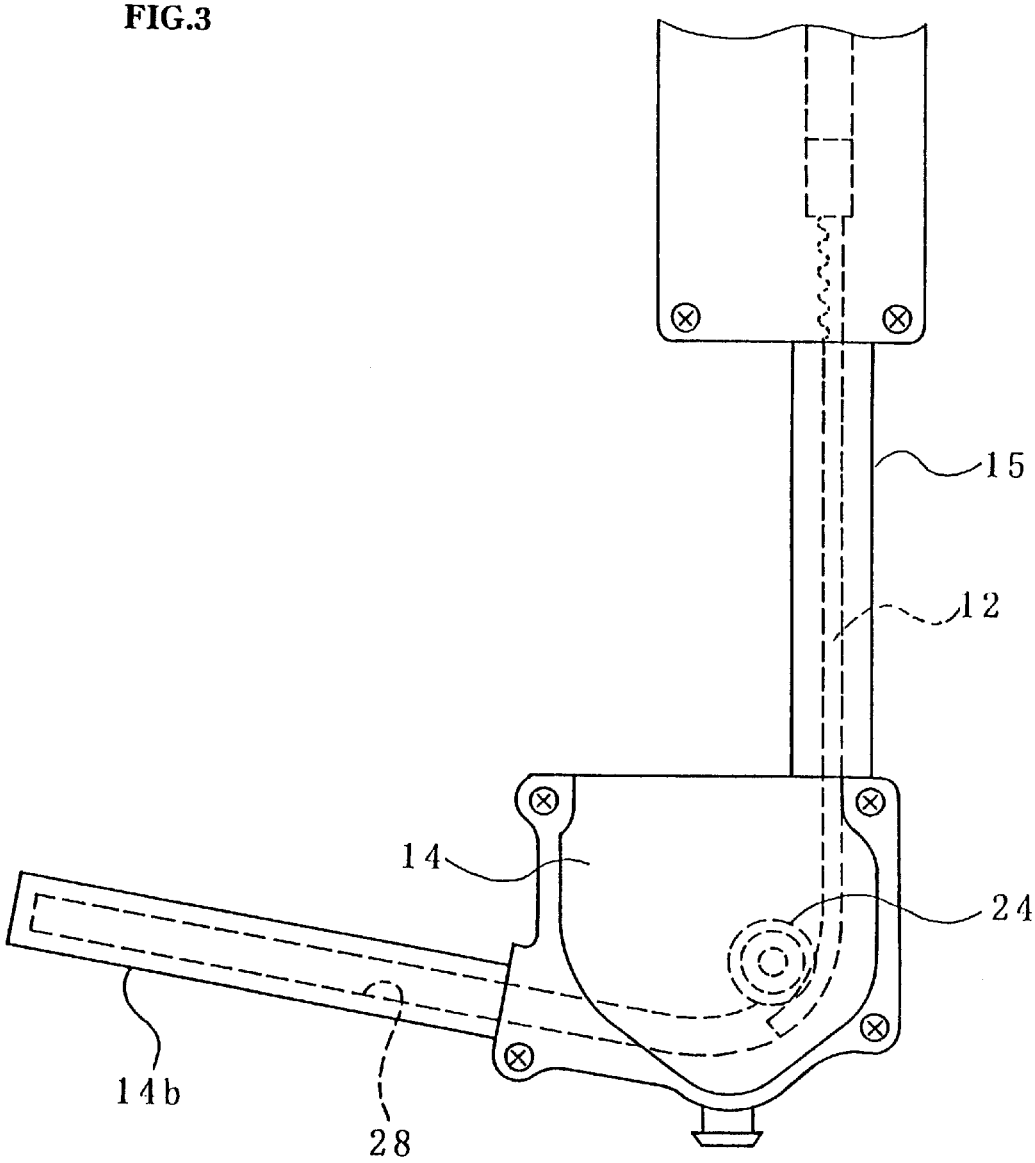
FIG. 3 is a diagram for representing a structure of a motor driven antenna apparatus according to another embodiment of the present invention.

Another embodiment shown in FIG. 3 owns the following different point from the embodiment shown in FIG. 1. That is, the guide 28 is formed in such a manner that this guide 28 is directed along the substantially transverse direction on the down stream side of the pinion gear 24 with respect to the projection direction of the antenna element 10 and the storage/move direction thereof. The rack cord 12 is stored into this case 14 while being curved in a substantially L-shape in such a way that this rack cord 12 is guided by the guide 28 formed on the case member 14*b* formed on the case 14. In accordance with another embodiment with employment of the above structure shown in FIG. 3, although the rack cord 12 is curved at an angle of about 90 degrees in the vicinity of the pinion gear 24, this rack cord 12 may be set in a substantially straight-line fashion on the down stream side thereof, so that there is a small curve. Accordingly, although the transverse width of the case 14 is increased, the friction resistance force caused by the abutment/movement between the guide 28 and the rack cord 12 may be small, and furthermore, torque required to rotary-drive the pinion gear 24 may be decreased.

It should be understood that the present invention is not limited only to the above-explained motor driven antenna apparatus according to the above-described embodiment, but may be applied to any other motor driven antenna apparatuses such that the rack cord 12 is moved to be stored while being guided/curved along the guides 26 and 28 without employing the rotating wind-up drum. Furthermore, the rack cord 12 may be alternatively moved in a straight line fashion without being curved.

Next, the structure of the base end portion of the antenna element 10 employed in the motor driven antenna apparatus will now be explained with reference to FIG. 4 to FIG. 9. First, in FIG. 4, the cylindrical-shaped base 15 is formed from the case 14 (not shown), and this cylindrical-shaped base 15 is fixed in a hole 22*a* of the vehicle body 22 by being screwed by the top nut 20 by employing the earth fitting member 16 and the sandwiching member 18. Under the projection condition of the antenna element 10, such a length is defined by that a straight-line-shaped conductive line 30 extended from the base end of the antenna element 10 penetrates through the earth fitting member 16, and a connection fitting member 32 is electrically connected to the earth fitting member 16 at an edge portion thereof at a position not opposed to the earth fitting member 16, which is formed with the antenna element 10 in an integral body. Apparently, this connection fitting member 32 may be freely moved within the cylindrical-shaped base 15 along the axial direction in connection with the movement of the antenna element 10 along the axial direction. Then, a power supply fitting member 34 is arranged on an inner peripheral wall of the cylindrical-shaped base 15 in correspondence with the position of the connection fitting member 32, and then, this power supply fitting member 34 is elastically made in contact with conductive/elastic tongues 36, 36, - - - , so as to be electrically connected. The conductive/elastic tongues 36, 36, - - - , have electric conductive characteristics, and are formed on the outer peripheral portion of the connection fitting member 32. An electronic circuit storage housing unit 38 is provided in the vicinity of this power supply fitting member 34 independent from the cylindrical-shaped base 15. Then, such an electronic circuit 40 as an amplifying circuit and a matching circuit is stored into this electronic circuit storage housing unit 38. Furthermore, the electronic circuit 40 is electrically connected to the power supply fitting member 34 by way of a conductive line path 42 having a short pre-selected dimension as a signal path.

Then, the antenna element 10 is arranged in such a manner that while the base end of this antenna element 10 is projected upwardly from the sandwiching member 18 under projection condition of this antenna element 10, this base end is separated by a pre-selected distance. In this case, the sandwich member 18 is an electric conductive member, the potential of which is equal to that of the vehicle body 22. If this sandwich member 18 is not such an electric conductive member, then the base end of the antenna element 10 may be alternatively projected in such a manner that this base end is separated upwardly from the vehicle body 22 by a pre-selected distance. In other words, the base end of the antenna element 10 may be separated from either the vehicle body 22 or the conductive member whose potential is equal to that of this vehicle body 22 by a pre-selected distance.

Figure 9:
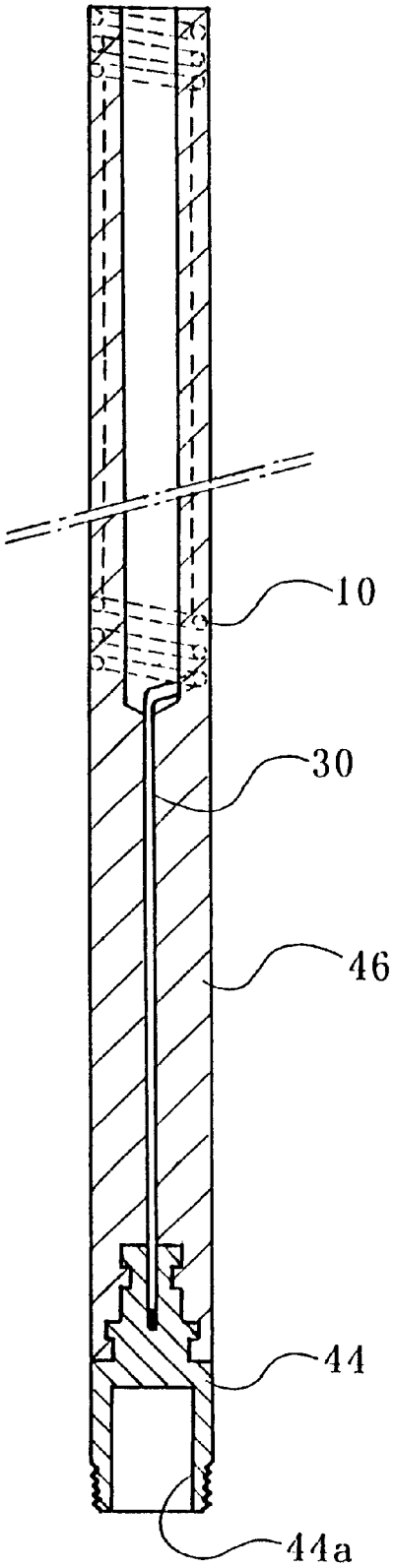
FIG. 9 is a cross-sectional view for showing an insulating resin rod in which an antenna element is formed with a connection base in an integral form by insert molding.

Moreover, referring now to FIG. 5 to FIG. 9, a detailed description is made of such a structure that the antenna element 10 is formed with the connection fitting member 32 in an integral body. That is, the straight-line-shaped conductive line 30 is extended from the base end of the antenna element 10 constructed of the helical coil, and the tip portion of this straight-line-shaped conductive line 30 is electrically connected to a connection base 44 made of an electric conductive member by way of the soldering manner. Then, both the outer diameter of the antenna element 10 and the outer peripheral portion of the connection base 44 are fixed by the molding. Then, as indicated in FIG. 9, an insulating resin rod 46 is formed by the insert molding, and these structural elements are formed in an integral body. This integral-formed antenna element 10 is entirely covered with an antenna cover 48 made of an insulating resin. A larger-diameter portion is provided on an outer peripheral portion of an intermediate portion of this antenna cover 48 along the axial direction so as to set such a condition that the top nut 20 cannot pass through this larger-diameter portion, namely preventing pass-through along the projection direction. A hole 44*a* having a bottom is formed in a lower end surface of the connection base 44, and while the tip portion of the rack cord 12 is sandwiched and also geared, a first holder 50 and a second holder 52 are inserted into this hole 44*a* having the bottom.

As illustrated in FIG. 7 and FIG. 8, a concave/convex portion 50*a* which is geared with the rack of the rack cord 12 is provided on an inner peripheral wall of the first holder 50. Also, projections 50*b*, 50*b*, - - - , and engaging holes 52*b*, 52*b*, - - - , are provided opposite to each other on an abutting plane between the first holder 50 and the second holder 52. Furthermore, larger-diameter portions 50*c* and 52*c* are formed on the first and second holders 50 and 52 in such a way that these larger-diameter portions 50*c* and 52*c* are continued around an axis. Both the first holder 50 and the second holder 52 which are combined with each other by sandwiching the tip portion of the rack cord 12 are inserted into the hole 44*a* having the bottom of the connection base 44, and are rotatable around the axis.

Furthermore, a fixing nut member 54 made of an conductive material is screwed with the lower end portion of the connection base 44 in order that both the first and second holders 50 and 52 are not extracted from the hole 44*a* having bottom. A hole is formed in this fixing nut member 54, and this hole has such a diameter through which both the larger-diameter portions 50*c* and 52*c* of the first and second holders 50 and 52 are not extracted. Thus, the rack cord 12 can be freely rotated around the axis with respect to the connection base 44, and moreover, can be prevented to be extracted therefrom, and is coupled to the connection base 44. An outer diameter of this fixing nut member 54 is substantially equal to that of the antenna cover 48. In addition, grooves around the axis are properly formed in the lower end portions of the fixing nut member 54 and of the antenna cover 48.

Furthermore, as shown in FIG. 6, a joint pipe 56 made of a conductive material is fitted, while bridging over the lower end portion of the antenna cover 48 and the outer peripheral portion of the fixing nut member 54, and this joint pipe 56 is caulked, so that the antenna cover 48 is coupled to be fixed with the fixing nut member 54. A plate member is provided to wind the outer peripheral portion of this joint pipe 56 around the axis, and is fixed thereon by way of the spot welding manner and further is electrically connected thereto. A plurality of conductive elastic tongues 36, 36, - - - , made of conductive materials and also having elastic characteristics are formed on this plate member while being expanded along the outer peripheral direction. In this case, the connection base 44, the fixing nut member 54, and the joint pipe 56 are electrically connected to each other, which may form the connection fitting member 32. Also, the connection conductive member is formed by the connection base 44 and the fixing nut member 54.

With employment of the above-described structure, since the base end of the antenna element 10 is separated from either the vehicle body 22 or the conductive member having the same potential as that of this vehicle body 22 by a predetermined distance , so that this base end is projected from the vehicle body 22, the stray capacitance produced between the base end portion of the antenna element 10 and the vehicle body 22 can be suppressed to become small. Also, under such a projection state of the antenna element 10, both the connection fitting member 32 and the power supply fitting member 34 are not located at the positions corresponding to the earth fitting member 16. Thus, the stray capacitance produced among the earth fitting member 16, the connection fitting member 32, and also the power supply fitting member 34 can be considerably reduced, as compared with the conventional case that these connection fitting member, power supply fitting member, and earth fitting member are located at the positions corresponding to the earth fitting member 16. Then, since the diameter of the straight-line-shaped conductive line 30 which passes through the earth fitting member 16 is narrow, the distance between this straight-line-shaped conductive line 30 and the earth fitting member 16 is extended and further the opposite area is reduced, so that the stray capacitance produced in the straight-line-shaped conductive line 30 is very small. In addition, the stray capacitance may be furthermore decreased by such a fact that the conductive line 42 defined from the power supply fitting member 34 to the electronic circuit 40 becomes short. As a consequence, a total capacitance value of stray capacity produced in the signal paths defined from the base end of the antenna element 10 to the electronic circuit 40 is small. As a result, a large external load impedance can be obtained, and thus, the attenuation of the AM band signal is small, so that the AM band signal having the large level is transferred to the electronic circuit 40.

Also, since the first holder 50 and the second holder 52 which are inserted into the hole 44*a* having the bottom of the connection base 44 can be rotated around the axis within the hole 44*a* having the bottom, the antenna cover 48 can be relatively rotated around the axis with respect to the rack cord 12. As a consequence, even when the force along the twist direction is given to the antenna cover 48, there is no risk that the rack cord 12 is twisted. Moreover, since the joint pipe 56 for coupling the rack cord 12 to the lower end portion of the insulating resin covering member for surrounding the antenna element 10 is commonly used as the structural member for electrically connecting the base end of the antenna element 10 to the power supply fitting member 34, a total number of components required to construct the motor driven apparatus can be reduced. Then, the connection fitting member 32 for coupling the rack cord 12 is formed in such a manner that both the first holder 50 and the second holder 52 for sandwiching the rack cord 12 and also geared with the rack are inserted into the hole 44*a* having the bottom of the connection base 44, and furthermore the fixing nut member 54 is screwed with the connection base 44, which can prevent the first and second holders 50 and 52 from being extracted from the hole 44*a* having the bottom. As a consequence, since the joint pipe 56 is caulked, the fixing nut member 54 is fixed, so that extraction of the rack cord 12 can be firmly blocked.

Also, since the plate member on which a plurality of conductive elastic tongues 36, 36, - - - , are formed is wound on the joint pipe 56 to be welded, the strength of the joint pipe 56 is high, as compared with such a case that the joint pipe 56 itself is cut/raised and then, the conductive elastic tongues 36, 36, - - - , are formed. In this case, since the joint pipe 56 itself is fixed by the caulking manner, it is not preferable to employ a thick plate member, or an excessively hard material. As a consequence, since the plate member on which the conductive elastic tongues 36, 36, - - - , are formed is wound on the joint pipe to be fixed, this joint pipe can be properly caulked and furthermore, the structure having the high strength can be made. Furthermore, since a plurality of conductive elastic tongues 36, 36, - - - , formed on the joint pipe 56 are elastically made in contact with the power supply fitting member 34, the electric connection can be firmly established.

Furthermore, since both the antenna element 10 and the connection base 44 electrically connected to this antenna element 10 are embedded into the insulating resin rod 46 by the insert molding in an integral molding, a total number of structural components can be reduced, and the antenna element can be easily assembled with respect to the cylindrical-shaped base 15. Moreover, there is no fluctuation in the dimensions between the antenna element 10 and the connection base 44, so that a constant antenna characteristic can be obtained.

In the above-described embodiment, the connection fitting member 32 is arranged by a plurality of members, the present invention is not limited thereto. Alternatively, the present invention may be applied to any structures manufactured by such that the rack cord 12 maybe coupled to this connection fitting member 32 and the base end of the antenna element 10 may be electrically connected to the joint pipe 56. Also, in the embodiment, the electronic circuit storage housing unit 38 is provided independent from the case 14 in order to arrange the electronic circuit 40 in the vicinity of the power supply fitting member 34. Alternatively, the electronic circuit 40 may be arranged in the case 14, and may be connected to the power supply fitting member 34 by employing such a coaxial cable having a small attenuation. Furthermore, in the embodiment, the line material for constituting the antenna element 10 is extended at the base end along the axis so as to be used as the straight-line-shaped conductive line 30. Alternatively, any electrical conductive lines independent from the antenna element 10, and rod-shaped members made of conductive materials may be used to constitute the straight-line-shaped conductive line 30. Furthermore, the above-described embodiment has explained such an assumption that the present invention is embodied in the on-vehicle motor driven antenna apparatus. Alternatively, the present invention may be similarly applied to other types of antenna apparatuses which have the cylindrical-shaped base 15 fixed to the vehicle body 22 by employing the earth fitting member 16, and capable of freely projecting/extracting the antenna elements. For example, it is alternatively possible to realize an antenna apparatus in which an antenna element is manually extracted and/or drawn.

Moreover, in the above-described embodiment, the antenna cover 48 is employed to cover the insulating resin rod 46 which is insert-molded by embedding the antenna element 10. Alternatively, both the insulating resin rod 46 and the antenna cover 48 may be formed in an integral form. In other words, if the antenna element 10 is embedded into the resin and at least the outer peripheral portion thereof are not exposed, then the insulating resin rod 46 may also function as the antenna cover 48. As a result, the lower end portion of the insulating resin rod 46 functioning as the insulating resin covering member may be coupled/fixed with the fixing nut member 54 by the joint pipe 56. It is of course possible to arrange the antenna apparatus such that this insulating resin rod 46 is formed in a pipe shape, and no "drop" is produced in the insulating resin when the insert molding is carried out.

Also, the conductive elastic tongues 36, 36, - - - , are formed on the joint pipe 56 by way of the welding manner. The present invention is not limited to this structure. For example, the joint pipe 56 itself may be cut/raised to form these conductive elastic tongues. In addition, such conductive elastic tongues 36, 36, - - - , may be provided which are elastically made in contact with the joint pipe 56 on the side of the power supply fitting member 34 so as to be electrically connected thereto.

Figure 10:
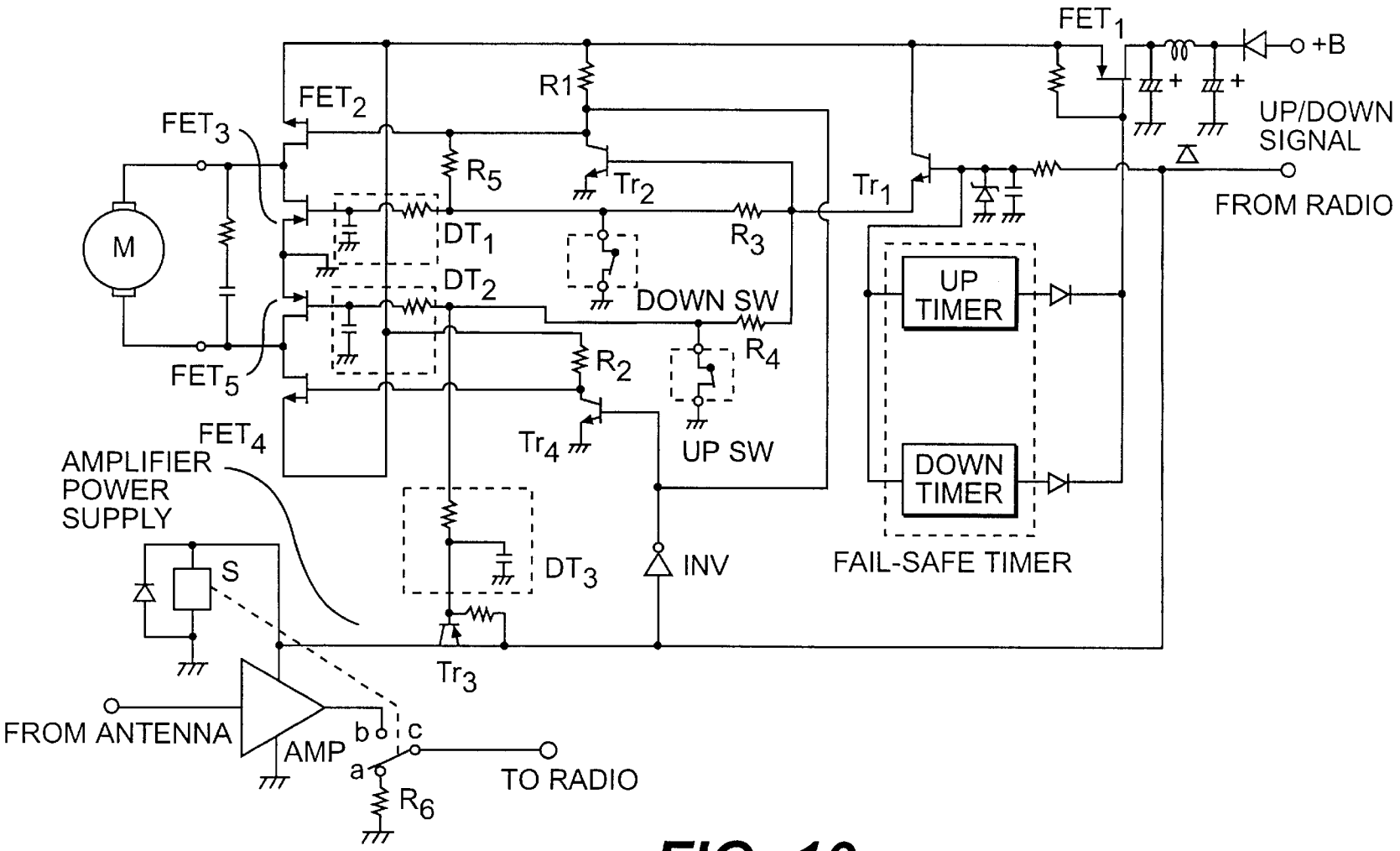
FIG. 10 is a circuit diagram of a motor driven antenna apparatus according to an embodiment of the present invention.

Referring now to FIG. 10, a description will be made of a circuit for controlling the motor driven antenna apparatus according to the present invention. A power supply terminal "+B" is connected via a forward direction diode and a smoothing circuit to a drain of a P-channel type MOS field-effect transistor FET1. A source of this field-effect transistor FET1 is connected to the ground via a series circuit of an N-channel type MOS field-effect transistor FET2 and another P-channel type MOS field-effect transistor FET3. A source of the field-effect transistor FET1 is connected to the ground via a series circuit of another N-channel type MOS field-effect transistor FET4 and another P-channel type MOS field-effect transistor FET5. Then, a drive motor M is inserted between a joint point between the field-effect transistor FET2 and the field-effect transistor FET3, and another joint point between the field-effect transistor FET4 and the field-effect transistor FET5. Furthermore, the source of the field-effect transistor FET1 is connected to a collector of a transistor Tr1, and further, is connected via a resistor R1 to a collector of a transistor Tr2 and also the gate of the field-effect transistor FET2. Also, the source of the field-effect transistor FET1 is connected via another resistor R2 to a collector of a transistor Tr4 and the gate of the field-effect transistor FET4. Then, an UP/DOWN terminal is connected to both the emitter of the transistor Tr3 and an input terminal of an inverter INV. Also, this UP/DOWN terminal is connected via a smoothing circuit to both the base of the transistor Tr1, and an UP timer/DOWN timer of a fail-safe timer. Either an UP signal for lifting the antenna element 10 or a DOWN signal for lowering the antenna element 10 is selectively supplied to the UP/DOWN terminal from a receiver. The output terminal of the UP timer and the output terminal of the DOWN timer are connected to the gate of the field-effect transistor FET1. When the UP signal corresponding to the "H" signal is supplied to the UP/DOWN terminal of the UP timer, this UP timer starts the time counting operation, and outputs the "H" signal while executing the time counting operation. Also, when the DOWN signal corresponding to the "L" signal is supplied to the UP/DOWN terminal of the DOWN timer, this DOWN timer starts the time counting operation, and outputs the "H" signal while executing the time counting operation. These time measuring time is set to a time duration during which the antenna element 10 can be sufficiently lifted, or lowered. Furthermore, the emitter of the transistor Tr1 is connected to the base of the transistor Tr2, and via a series circuit of a resistor R3 and a delay circuit DT1 to the gate of the field-effect transistor FET3, and also via a series circuit of a resistor R4 and a delay circuit DT2 to the gate of the field-effect transistor FET5. Then, the joint point between the resistor R3 and the delay circuit DT1 is connected via a resistor R5 to the collector of the transistor Tr2, and also via a DOWN switch to the ground. Also, the joint point between the resistor R4 and the delay circuit DT2 is connected via the UP switch to the ground, and also is connected via the delay circuit DT3 to the base of the transistor Tr3. It should be understood that when the antenna element 10 is lowered up to the lower end, the DOWN switch is turned ON, whereas when the antenna element 10 is lifted up to the lift-up end, the UP switch is turned ON. Furthermore, the collector of the transistor Tr3 is connected to a power supply terminal of an amplifying circuit AMP functioning as an amplifying means for amplifying an antenna output. Furthermore, the power supply terminal of this amplifying circuit AMP is grounded via a solenoid coil "S" of a relay. Then, the output terminal of the amplifying circuit AMP is connected to a normally-open contact "b" of the relay. A normally-close contact "a" of this relay is grounded via a resistor R6 having 75 ohms, and a common contact "c" thereof is connected to a signal path to the receiver. A muting means is constituted by these contacts of the relay. Also, the output terminal of the inverter INV is connected to the base of the transistor Tr4, and also to the collector of the transistor Tr2. Both the emitter of the transistor Tr2 and the emitter of the transistor Tr4 are grounded. The resistance value of the resistor R5 is set to be very small, as compared with the resistance value of the resistor R3.

With employment of the above-described circuit arrangement, under such a condition that the antenna element 10 is lowered so that the DOWN switch is turned ON and the UP switch is turned OFF, when the UP signal is supplied to the UP/DOWN terminal, the transistor Tr1 is first turned ON, and the UP timer commences the time counting operation, and further, the field-effect transistor FET1 is turned ON. Since this transistor Tr1 is turned ON, the transistor Tr2 is similarly turned ON and the field-effect transistor FET2 is turned ON. Also, the field-effect transistor FET5 is turned ON. In this case, both the field-effect transistors FET3 and FET4 are turned OFF. As a result, the drive motor M is rotatably driven, so that the antenna element 10 starts to be lifted. Since the antenna element 10 is lifted, the DOWN switch is turned OFF. However, since the value of the resistor R5 is very small, the field-effect transistor FET3 is continued to be turned OFF. Then, when the antenna element 10 is moved up to the lift-up end to cause the UP switch to be turned ON, the field-effect transistor FET5 is turned OFF after the delay time defined by the delay circuit DT2. Also, after the delay time defined by the delay circuit DT3, the transistor Tr3 is turned ON, so that the operating voltage is applied to the amplifying circuit AMP so as to be brought into the operating condition, and also the relay is brought into the energizing state. Therefore, both the normally-open contact "b" and the common contact "c" are become conductive, so that the muting operation is released. Then, furthermore, the UP timer completes the time counting operation, and the field-effect transistor FET2 is also turned OFF.

Also, when the DOWN signal is supplied to the UP/DOWN terminal under this condition, applying of the operating voltage to the emitter of the transistor Tr3 is interrupted, so that the amplification operation of the amplifying circuit AMP is stopped, the relay is brought into the non-energizing state, and both the normally-close contact "a" and the common contact "c" are become conductive. Thus, the signal path is grounded via the resistor R6 having the resistance value of 75 ohms, so that the muting operation is carried out. Also, the DOWN timer starts the time counting operation thereof and the output of this DOWN timer becomes the "H" signal, so that the field-effect transistor FET1 is turned ON. Then, since the output of the inverter INV is the "H" signal, this "H" signal is applied via the resistor R5 to the gate of the field-effect transistor FET3 so as to turn ON the field-effect transistor FET3, and the transistor Tr4 is also turned ON, so that the field-effect transistor FET4 is turned ON. In this case, both the field-effect transistors FET2 and FET5 are turned OFF. As a result, the drive motor M is rotatably driven along the reverse direction, so that the antenna element 10 starts to be lowered. Then, when the antenna element 10 is reached to the lower end, the DOWN switch is turned ON and the field-effect transistor FET3 is turned OFF, so that the drive motor M is stopped. Furthermore, when the DOWN timer completes the time counting operation, the field-effect transistor FET1 is turned OFF. It should be understood that the relay is brought into the non-energizing state and the muting operation is carried out in a time period other than such a time period during which the amplifying circuit AMP is brought into the operation condition.

As previously explained, in the embodiment shown in FIG. 10, when the antenna element 10 is reached to the lift-up end, the amplifying circuit AMP is brought into the operation condition. As a consequence, while the antenna element 10 is being lifted up and the signal level of the antenna out is still low, this low-leveled antenna output is not amplified. Also, under such a condition that the connection fitting-member 32 to which the base end of the antenna element 10 is connected is not yet elastically made in contact with the power supply member 34, the signal path is grounded via the resistor having the resistance value of 75 ohms, so that the muting operation is carried out. As a consequence, the sounds are not implied in the receiver, and there is no risk that unpleasant feeling caused by the noise is given to the users.

Figure 11:
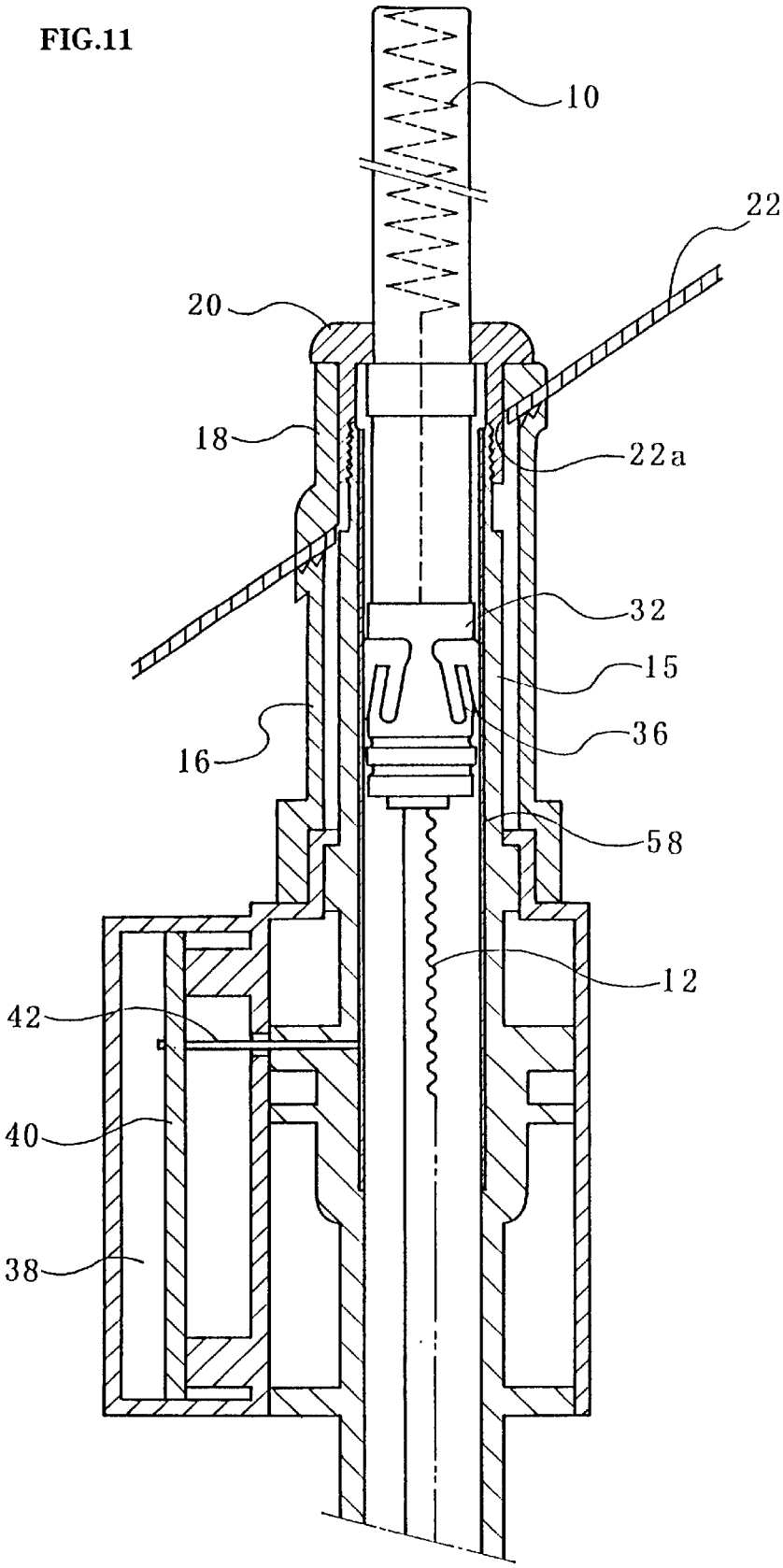
FIG. 11 shows a structure of a motor driven antenna apparatus according to a second embodiment of the present invention, namely mainly indicates a structure portion of this second embodiment different from the embodiment shown in FIG. 4.

Furthermore, a motor driven antenna apparatus according to another embodiment of the present invention will now be made with reference to FIG. 11. In FIG. 11, this embodiment owns the following different structure from that of the above embodiment shown in FIG. 4. That is, a hot tube 58 made of a conductive material, which is long along an axis direction, is arranged on an inner peripheral wall of the cylindrical-shaped base 15, and a base end portion thereof is electrically connected via the electric conductive line path 42 to the electronic circuit 40. Under such a condition that the antenna element 10 is projected from the vehicle body 22, the connection fitting member 32 is arranged on the side of the base end thereof at a position where this connection fitting member 32 is faced with the earth fitting member 16, and also is electrically connected to the base end of the antenna element 10. This connection fitting member 32 is moved within the hot tube 58 along the axis direction while the antenna element 10 is moved along the axis direction. At least under the projection condition of the antenna element 10, this connection fitting member 32 is elastically made in contact with the hot tube 58 by employing the conductive elastic tongues 36, 36, - - - , so as to be electrically connected thereto.

Figure 4:
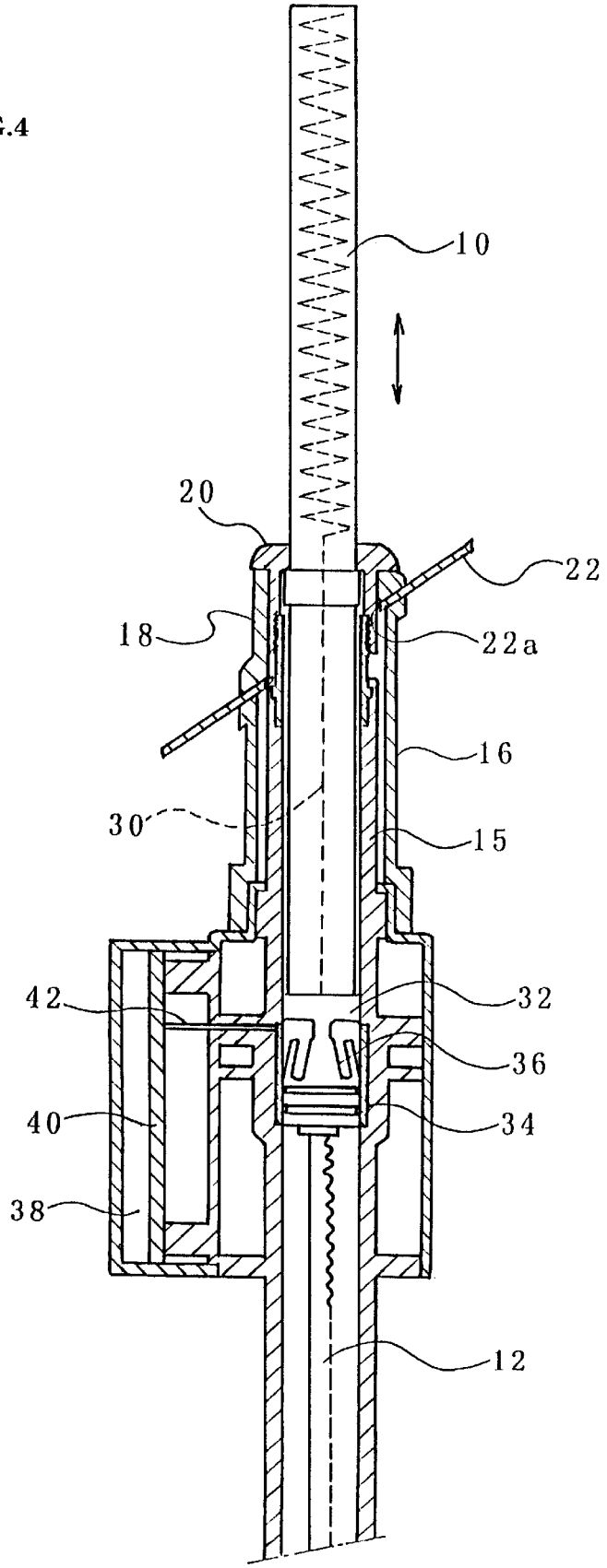
FIG. 4 is a cross-sectional view for indicating a structure of a base end portion of an antenna element of the motor driven antenna apparatus shown in FIG. 1.
Figure 5:
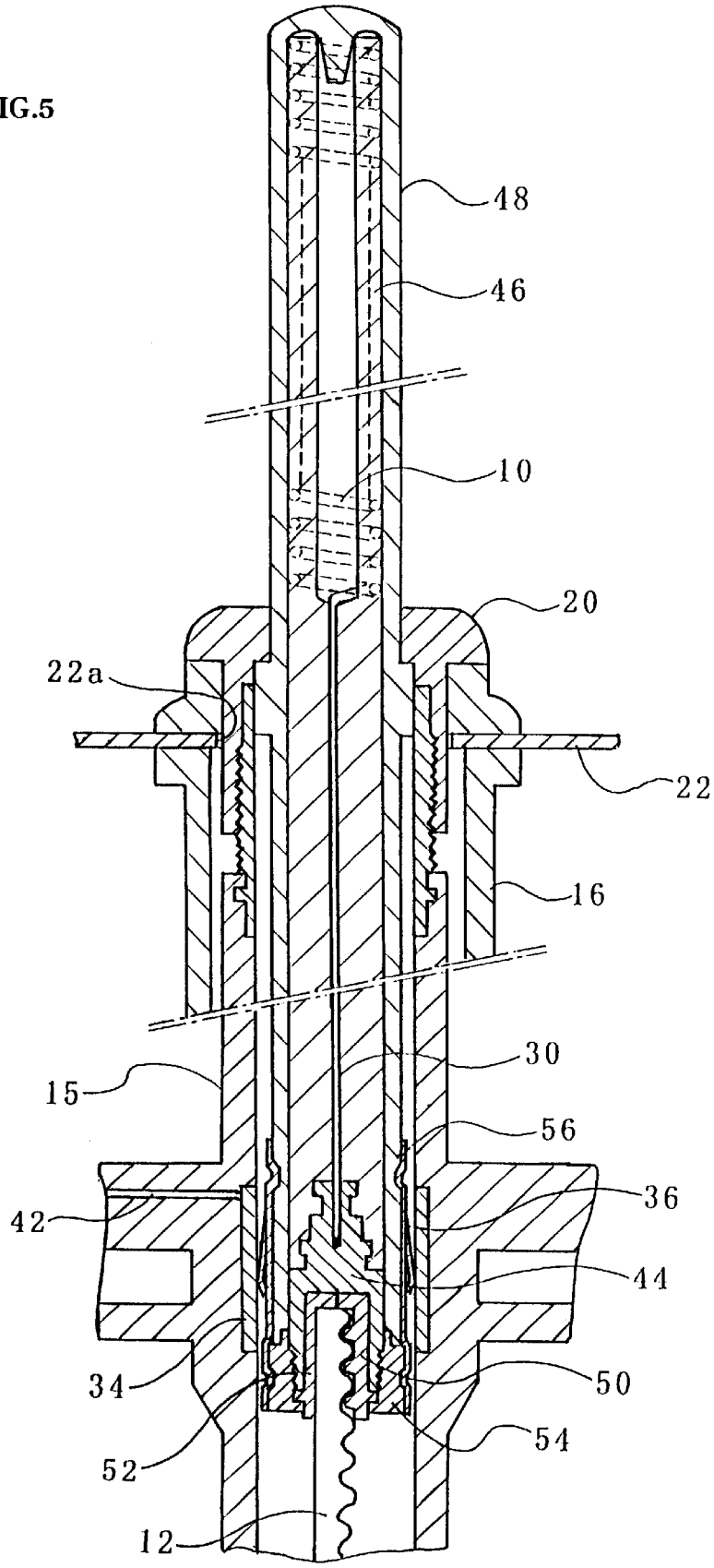
FIG. 5 is an enlarged cross-sectional view for indicating an antenna element and a connection fitting member.

With employment of the above-described arrangement, the dimension defined from the tip portion of the antenna element 10 up to the connection fitting member 32 can be made shorter than that of FIG. 4, which may suitably shorten the overall dimension of the motor driven antenna apparatus. In this case, the stray capacitance produced between the hot tube 58 and the earth fitting member 16 can be sufficiently reduced by setting the distance between the outer diameter of the hot tube 58 and the inner diameter of the earth fitting member 16 to be a long distance. Then, the earth fitting member 16 is loosely fitted to the cylindrical-shaped base 15, so that the inner diameter of this earth fitting member 16 can be readily set to the large diameter. In accordance with the experiments executed by the Inventors, since the inner diameter of the earth fitting member 16 was made more than 1.2 times larger than the outer diameter of the hot tube 58, the stray capacitance between these members could be sufficiently reduced. Thus, the AM band signal could be applied to the electronic circuit 40 without any practical problems.

INDUSTRIAL APPLICABILITY

As previously described, in accordance with the motor driven antenna apparatus of the present invention, since the length of this antenna element is shortened, the our dimension of the entire antenna apparatus can be shortened. As a result, this antenna apparatus is suitable for the on-vehicle antenna arranged on the vehicle body. Moreover, the length of the rack cord for projecting and storing the antenna element can be made short, the structure of this rack cord can be made simple, and no malfunction thereof occurs.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A motor driven antenna apparatus comprising:

a rack cord coupled in a coaxial direction to a base end portion of an antenna element, said antenna element being constructed of a helical coil;

a pinion gear coupled to a motor drive unit geared with a rack of said rack cord; and said antenna element being movable to be projected and stored by way of a rotating drive of said motor drive unit.

2. The motor driven antenna apparatus according to claim 1 wherein:

said rack cord is moved in either a curve manner or a straight-line manner by the rotating drive of said motor drive unit.

3. The motor driven antenna apparatus according to claim 1, wherein:

a guide provided in a case by which said rack cord can be moved while said rack cord abuts against said guide while being curved.

4. The motor driven antenna apparatus according to claim 1, wherein:

said antenna element further includes an insulating resin covering member surrounding an outer peripheral portion of an antenna element.

5. A motor driven antenna apparatus comprising:

a rack cord having a flexibility coupled in a coaxial direction to a base end portion of an antenna element made of a helical coil;

a pinion gear coupled to a motor drive unit geared with a rack of said rack cord; said rack cord, said motor drive unit, and said pinion gear stored into a case;

a guide provided in said case by which said rack cord can be moved while said rack cord abuts against said guide while being curved;

said antenna element is movable to be projected and stored by a rotating drive of said motor drive unit; and said rack cord is moved while said rack cord abuts against the guide.

6. The motor driven antenna apparatus according to claim 5 wherein:

said rack cord is curved at an angle more than 180 degrees under storage condition of said antenna element.

7. The motor driven antenna apparatus according to claim 5, wherein:

said guide is formed by a pipe-shaped case member formed within said case and projected from said case toward either a projection direction or a transverse direction with respect to the projection direction and the storage or move direction of said antenna element; and under storage condition of said antenna element, said rack cord is bent in either a U-shaped manner or an L-shaped manner while said rack cord is curved along said guide.

8. A motor driven antenna apparatus comprising:

an antenna element freely projected or stored from or into a cylindrical-shaped base along an axial direction;

said cylindrical-shaped base penetrated through a hole formed in a vehicle body;

an earth fitting member fitted into an outer peripheral portion of said cylindrical-shaped base;

a sandwiching member inserted into the outer peripheral portion of said cylindrical-shaped base and a top nut screwed to a tip portion of said cylindrical-shaped base; said vehicle body is sandwiched by said earth fitting member and said sandwiching member by screwing said top nut so as to fix said cylindrical-shaped base to said vehicle body; and said antenna element is projected from said vehicle body, a straight-line-shaped conductive line extended from a base end of said antenna element while having a length defined when said straight-line-shaped conductive line is penetrated through said earth fitting member;

a connection fitting member movable along the axial direction fixed on said cylindrical-shaped base and said position of said earth fitting member is not faced to said straight-line-shaped conductive line and is electrically connected thereto; and a power supply fitting member made of a conductive material and positioned in correspondence with the connection fitting member present, wherein said position is arranged on an inner peripheral wall of said cylindrical-shaped base, so that said connection fitting member is elastically made in contact with the power supply fitting member so as to be electrically connected.

9. The motor driven antenna apparatus according to claim 8 wherein:

an electronic circuit for amplifying an antenna output, or matching a circuit is arranged in the vicinity of said power supply fitting member; and the antenna output is supplied from said power supply fitting member to said electronic circuit by way of a signal path having a pre-selected short dimension.

10. The motor driven antenna apparatus according to claim 8 wherein:

said antenna element and said straight-line-shaped conductive line, and further, either the connection fitting member or a structural member of said connection fitting member are formed in an integral body by employing an insulating resin.

11. A motor driven antenna apparatus comprising:

an antenna element freely projected or stored from or into a cylindrical-shaped base along an axial direction; said cylindrical-shaped base is penetrated through a hole formed in a vehicle body;

an earth fitting member fitted into an outer peripheral portion of said cylindrical-shaped base;

a sandwiching member inserted into the outer peripheral portion of said cylindrical-shaped base and a top nut screwed to a tip portion of said cylindrical-shaped base; said vehicle body is sandwiched by said earth fitting member and said sandwiching member by screwing said top nut so as to fix said cylindrical-shaped base to said vehicle body; whereby said antenna element is projected from said vehicle body, a base end of said antenna element projected from either said vehicle body or an electric conductive member at the same potential as that of said vehicle body by a predetermined distance;

a straight-line-shaped conductive line extended from the base end of said antenna element;

a connection fitting member movable along the axial direction fixed on said cylindrical-shaped base and further electrically connected to said straight-line-shaped conductive line; and a power supply fitting member made of a conductive material and positioned in correspondence with the connection fitting member present at said position arranged on an inner peripheral wall of said cylindrical-shaped base, so that said connection fitting member is elastically made in contact with the power supply fitting member so as to be electrically connected.

12. A motor driven antenna apparatus comprising:

an antenna element freely projected or stored from or into a cylindrical-shaped base along an axial direction; said cylindrical-shaped base is penetrated through a hole formed in a vehicle body;

an earth fitting member loosely fitted into an outer peripheral portion of said cylindrical-shaped base;

a sandwiching member inserted into the outer peripheral portion of said cylindrical-shaped base and a top nut screwed to a tip portion of said cylindrical-shaped base; said vehicle body is sandwiched by said earth fitting member and said sandwiching member by screwing said top nut so as to fix said cylindrical-shaped base to said vehicle body;

a hot tube made of an electric conductive material and being along an axis direction arranged on an inner peripheral wall of said cylindrical-shaped base;

a connection fitting member being movable within said hot tube along the axis direction and arranged on the side of the base end of said antenna element and is electrically connected thereto; whereby said antenna element is projected from the vehicle body, said connection fitting member elastically made in contact with said hot tube so as to be electrically connected.

13. The motor driven antenna apparatus according to claim 12 wherein:

an inner diameter of said earth fitting member is made more than 1.2 times larger than an outer diameter of said hot tube.

14. A motor driven antenna apparatus comprising:

an insulating resin covering member surrounding an outer peripheral portion of an antenna element;

a connection conductive member made of an electric conductive member for coupling one end of a rack cord arranged on a lower end of said insulating resin covering member;

a base end of said antenna element electrically connected to said connection conductive member;

a joint pipe made of an electric conductive material engaged with said connection conductive member while bridging both the lower end portion of said insulating resin covering member and said connection conductive member and caulked so as to couple or fix said insulating resin covering member and said connection conductive member, and further to electrically connect said joint pipe to said connection conductive member; both the coupled insulating resin covering member and said rack cord are movably inserted into the cylindrical-shaped base along the axis direction; under projection condition of said antenna element, a power supply fitting member made of an electric conductive material arranged on said cylindrical-shaped base in correspondence with said joint pipe; and said joint pipe electrically connected to said power supply fitting member by a conductive elastic tongue.

15. The motor driven antenna apparatus according to claim 14 wherein:

said connection conductive member constituted by a pair of holder members which are geared with the rack at one end of said rack cord and also sandwiches the rack cord, a connection base having a hole into which said holder members are inserted, and a fixing nut member which is screwed to said connection base in order that said holder members are not extracted from said hole; and said joint pipe is engaged with the outer peripheral portion of said fixing nut member and is caulked thereto, so that said fixed nut member is fixed.

16. The motor driven antenna apparatus according to claim 14, wherein:

a straight-line-shaped conductive line extended from the base end of said antenna element; said straight-line-shaped conductive line electrically connected to a connection base for constituting said connection conductive member; and both said antenna element and said connection base are embedded into an insulating resin rod by insert-molding so as to be formed in an integral body.

17. A motor driven antenna apparatus comprising:

a rack cord coupled to a base end portion of an antenna element in a coaxial direction, said antenna element being constructed of a helical coil;

a pinion gear coupled to a motor drive unit geared with a rack of said rack cord;

the antenna element being lifted and lowered by a rotary drive of the motor drive unit;

amplifying means for amplifying an antenna output of the antenna element and outputting an amplified antenna output; and control means for causing the amplifying means to be brought into an operating state when said antenna element is located at a lift-up end.

18. A motor driven antenna apparatus comprising:

a rack cord coupled to a base end portion of an antenna element in a coaxial direction, said antenna element being constructed of a helical coil;

a pinion gear coupled to a motor drive unit geared with a rack of said rack cord;

the antenna element being lifted and lowered by a rotary drive of the motor drive unit;

amplifying means for amplifying an antenna output of the antenna element and outputting an amplified antenna output;

muting means for muting a signal path for said amplified antenna output; and control means for causing the muting means to release the muting operation when said antenna element is located at a lift-up end.

* * * * *